US007942419B2

(12) United States Patent
Gelzinis et al.

(10) Patent No.: US 7,942,419 B2
(45) Date of Patent: May 17, 2011

(54) PORTABLE REBOUND BALL GAME

(76) Inventors: Anthony C. Gelzinis, Oaklyn, NJ (US); Theresa Gelzinis-Enoch, Marlton, NJ (US); Michael A. Gelzinis, Oaklyn, NJ (US)

( * ) Notice: Subject to any disclaimer, the term of this patent is extended or adjusted under 35 U.S.C. 154(b) by 64 days.

(21) Appl. No.: 12/590,736

(22) Filed: Nov. 13, 2009

(65) Prior Publication Data

US 2010/0066022 A1 Mar. 18, 2010

(51) Int. Cl.
*A63B 63/00* (2006.01)

(52) U.S. Cl. ..... 273/396; 473/435; 52/183

(58) Field of Classification Search ..... 273/395, 273/396; 473/434, 435; 52/182–191; 182/152–164; 108/64, 92, 100
See application file for complete search history.

(56) References Cited

U.S. PATENT DOCUMENTS 1,125,194 A * 1/1915 Sigmund ..... 108/100
1,514,055 A * 11/1924 Lawson ..... 108/100
2,740,165 A * 4/1956 Ward ..... 52/8
2,789,700 A * 4/1957 King et al. ..... 108/32
3,035,671 A * 5/1962 Sicherman ..... 52/183
3,564,790 A * 2/1971 Rehfeld ..... 52/183
3,747,708 A * 7/1973 Wenger et al. ..... 182/152
3,876,070 A * 4/1975 Nagy ..... 206/315.1
4,133,531 A * 1/1979 Arteaga et al. ..... 273/395
4,979,340 A * 12/1990 Wilson et al. ..... 52/9
5,357,876 A * 10/1994 Kniefel et al. ..... 108/92
5,407,210 A * 4/1995 Canning ..... 273/348
5,480,225 A * 1/1996 Bailey ..... 312/258
D381,840 S * 8/1997 Bevill et al. ..... D6/474
5,692,445 A * 12/1997 Winer ..... 108/100
5,901,505 A * 5/1999 Dettmann et al. ..... 52/6
5,967,519 A * 10/1999 Cumberland et al. ..... 273/317.6
6,205,722 B1 * 3/2001 Bromley et al. ..... 52/182
6,474,024 B1 * 11/2002 Macintyre ..... 52/9
6,585,610 B2 * 7/2003 Sompolinsky ..... 473/435
2008/0163571 A1 * 7/2008 Kohler ..... 52/183

* cited by examiner

*Primary Examiner* — Mark S Graham
(74) *Attorney, Agent, or Firm* — Stuart M. Goldstein

(57) ABSTRACT

A portable stepball game apparatus has a collapsible stairway with a plurality of steps. Each step has a vertical riser portion, a horizontal tread portion, and a nosing on the forward or player-facing edges of the tread portions which protrudes over the riser portions. The game's pivotable stairway configuration is readily housed for storage in a carrying case specifically adapted to be easily portable. It is designed such that one person can lift the carrying case with one hand and easily move it from location to location.

14 Claims, 5 Drawing Sheets

PORTABLE REBOUND BALL GAME

CROSS REFERENCE TO RELATED APPLICATIONS

This application claims the benefit of U.S. Provisional Application No. 61/012,144, filed Dec. 7, 2007 and U.S. Non-Provisional application Ser. No. 12/329,049, filed Dec. 5, 2008 now abandoned.

FIELD OF THE INVENTION

The present invention relates in general to a recreational game and in particular to a portable rebound ball game.

BACKGROUND OF THE INVENTION

Stepball or stoopball (the terms are used synonymously herein) is a game involving one or more players in which a ball is thrown at an outdoor flight of steps or stairway to strike one of the steps and rebound back toward the players. The object of the game is for a player to catch a ball thrown at the stairway after it has rebounded off one of the steps.

Because a suitable stoop or outdoor stairway may be unavailable or inaccessible for a variety of reasons, several portable stepball apparatus have been proposed by which players may conceivably play stepball in such places as a street, a parking lot, a playground, a park or campground, a back yard, a school yard, a driveway, or the beach or virtually any other outdoor location. Examples of such apparatus are disclosed in U.S. Pat. Nos. 4,133,531; 5,407,210; 5,531,449; 5,967,519 and 6,585,610.

Of these, U.S. Pat. Nos. 5,531,449 and 6,585,610 disclose devices comprising front and rear panels joined at an upper edge to form an assembly which, in operation, assumes the shape of an inverted "V". The sloped front panel of these devices functions as the game playing surface.

Classic stepball is played against an actual stoop or outdoor stairway consisting of steps having horizontal foot-supporting tread portions and vertical riser portions. In contrast, the sloped front panels U.S. Pat. Nos. 5,531,449 and 6,585,610 merely have slightly raised ridges or protrusions provided along sloping "riser" portions of the sloped front panel. The ridges or protrusions are neither structurally nor functionally equivalent in size, shape, depth, orientation or surface area to a tread portion of a step of a conventional stairway. And the slope of the "riser" portions of the front panel distorts the rebound that would be realized by a conventional vertical step riser. As such, the apparatus taught in U.S. Pat. Nos. 5,531,449 and 6,585,610 are in many ways incapable of simulating the rebound characteristics of stepball played on a conventional stairway.

U.S. Pat. Nos. 4,133,531; 5,407,210 and 5,967,519 disclose portable stepball apparatus having essentially vertical riser portions and essentially horizontal tread portions. While the apparatus disclosed in these patents more closely simulate the experience of "classic" stepball, they still cannot produce an optimal stepball experience.

In particular, none of these disclosures teach the use of a rebound ball game which, when in the game playing position, provides for a true stepball experience, yet is readily transportable in a stored position. In addition, the prior art fails to disclose the use of "nosing" on the forward or player-facing edges of the treads which protrude over (i.e., overhang) the risers beneath. The significance of nosing is that, in combination with treads of substantial depth (unlike the mere ridges or protrusions described in U.S. Pat. Nos. 5,531,449 and 6,585,610), a ball which strikes the nosing—in contrast with a simple "noseless" riser/tread edge—will undergo more complicated and unpredictable bounces, caroms or rebounds, thereby enhancing the challenge of a stepball game. That is, tread nosing produces an element of rebound unpredictability which is unattainable by the aforementioned patents.

An advantage exists, therefore, for a portable stepball game apparatus including a stairway with at least one step having an essentially vertical riser portion and an essentially horizontal tread portion and further including nosing on the forward or player-facing edges of the tread portion(s) which protrudes over the riser portions therebeneath, whereby the apparatus enables players to enjoy a more challenging experience than heretofore offered by portable stepball/stoopball devices heretofore known in the art.

The present invention is unique, as well, in its portability in handling and transport. It is designed such that one person can lift the carrying case of the invention with one hand and easily move it from location to location. It is, in fact, a game having a unique pivotable stairway configuration which is readily housed for storage in a case specifically designed to be carried. As such, the design and functionality of the game, coupled with its lightweight and ease of portability, can not be considered analogous in either design or function to large, vertically moveable riser systems used on stages or auditoriums.

SUMMARY OF THE INVENTION

The present invention provides a portable stepball/stoopball game apparatus including a lightweight, game stairway that is pivotably collapsible into a portable, handheld carrying case or frame which may be easily transported to and erected in virtually any play environment. The stairway comprises at least one step including an essentially vertical riser portion and an essentially horizontal tread portion wherein the tread portion includes nosing on its player-facing edge which protrudes over the riser portion therebeneath.

The game's carrying case includes a handle for picking up the entire case, with its stairway stored therein, for transporting the game. Optionally, the carrying case may include wheels, rollers, casters, skids and/or other means for facilitating pulled transport of the apparatus. The carrying case further includes a compartment for storing at least one ball, suitable for use in playing stepball.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
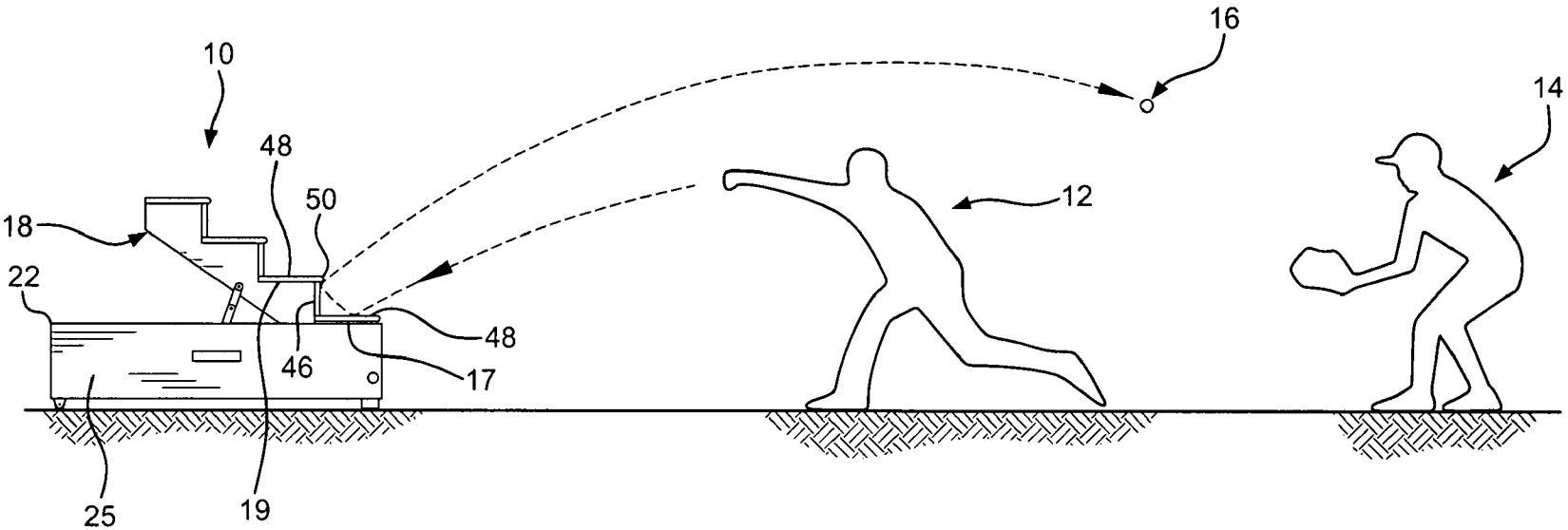
FIG. 1 is a schematic diagram illustrating how a game of stepball/stoopball may be played using the stepball rebound ball game of the present invention.

Referring to the drawings wherein like or similar references indicate like or similar elements throughout the several views, there is shown in FIG. 1 a schematic depiction of a typical play in a stepball game employing a portable stepball game apparatus according to the invention.

As shown in FIG. 1, portable stepball rebound ball game 10, with its stairway 18 is shown in side view along with (at least) first and second players 12 and 14. Player 12 plays the role of a pitcher and at least one player 14 plays the role of a fielder. To initiate play, pitcher 12 tosses a resilient ball 16 towards game 10. The ball rebounds off of any number of surfaces of stairway 18 that may result in an "out" or a "hit" as generally described below.

As generally described in U.S. Pat. No. 5,531,449, typical, although non-limitative, rules of a stepball game played with game 10, which have a number of similarities with baseball, are as follows:

1. Any number of players can play the game;
2. Ball 16 is thrown at a striking face of stairway 18 of game 10;
3. The rebounding ball 16 must stay in bounds;
4. If ball 16 bounces outside of unillustrated foul lines it is an automatic out;
5. All other outs are made by opposing player(s) 14 catching ball 16 on the fly;
6. Each player or team gets three outs;
7. Games can be played using a team or having each player keep their own individual scores;
8. The highest score wins; and
9. The usual length of a game is nine innings.

It will be understood, however, that players may invent any number of rebound games and rules; therefore using game 10 to satisfy their needs, desires and imagination as the above game rules are not to be considered restrictive.

Figure 2:
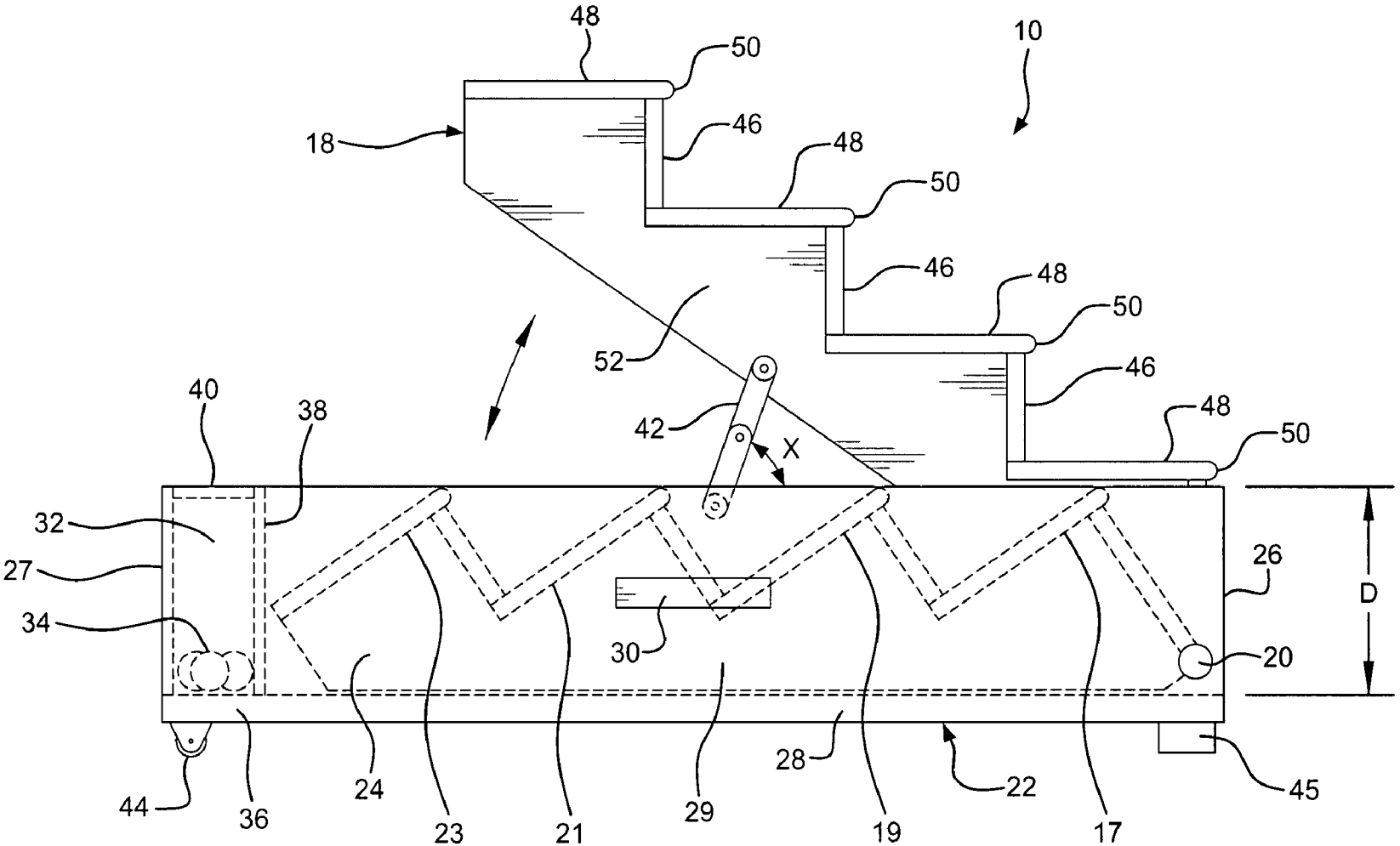
FIG. 2 is an elevation, partially ghosted view of the stepball rebound ball game of the present invention depicting its stairway in both its raised, game playing position and its stored position.
Figure 3:
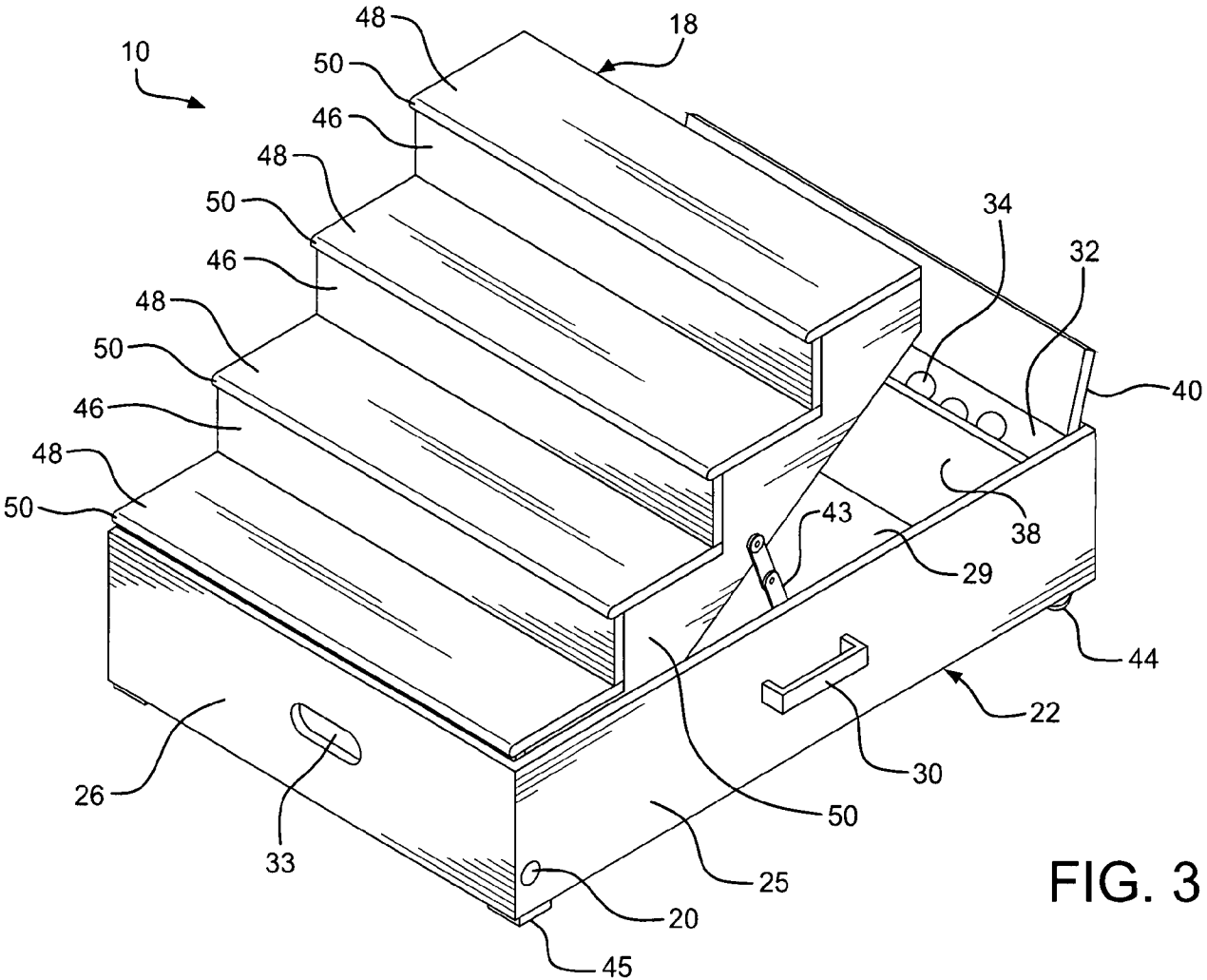
FIG. 3 is front perspective view of the stepball rebound ball game of the present invention in its raised, game playing position.

FIG. 2 (in solid lines) and FIG. 3 illustrate the first embodiment of game 10 of the present invention in upright, game playing position. Game 10 comprises forwardmost first step 17 and pivot connection 20 attached to carrying frame or case 22. Stairway 18 is thus vertically moveable between a stored position, wherein all steps of the stairway are located within open space 29 of carrying case 22, and a raised, game playing position wherein only the lowermost step of the stairway is located within the open space. While a pivoted connection between stairway 18 and carrying case 22 is preferred, it is not required. For example, stairway 18 and carrying case 22 may be connected to one another by one or more slots and tabs or other means for enabling placement of the stairway into its raised, game playing and stored positions.

Carrying case 22 has opposed lateral wall members 24 and 25 and end wall members 26 and 27 affixed substantially transverse to the side members. Lateral wall members 24 and 25 and end wall members 26 and 27 enclose open space 29. Carrying case 22 further includes bottom support framing 28 (FIG. 2) for supporting stairway 18 in its closed, stored position. Framing 28 may comprise a pair of opposed flanges provided on inner faces of lateral wall members 24 and 25 or it may be a flat bottom panel.

Carrying case 22 and stairway 18 may be fabricated from any suitable rugged material such as wood, plastic, metal, or any combination thereof, that is/are of sufficient strength to sustain the structural integrity of the frame and stairway in both operative and inoperative positions of the stairway. Although not illustrated, carrying case 22 may also include a cover configured to be situated atop lateral wall members 24 and 25 for inhibiting ingress of moisture and debris when stairway 18 is in a collapsed, stored position.

Carrying case 22 includes carrying side handles 30 and 31 and slots 33 and 35 to allow one person to manually lift the carrying case off the ground and easily transport it, with stairway 18 stored therein.

Carrying case 22 also comprises, at the rear end of the case, carrying case compartment 32 located within open space 29. Compartment 32 is configured to house at least one resilient playing ball 34. As most clearly shown in FIG. 2, compartment 32 desirably includes floor member 36 and front wall member 38, which in combination with end wall member 27, form a receptacle for holding ball(s) 34. Compartment 32 is selectively opened and closed by cover 40 which may be pivoted, snapped, latched, friction-fit, or otherwise connected or connectable to carrying case 22.

Stairway support members 42 and 43 releasably maintain stairway 18 in an upright, raised, game playing position. Support members 42 and 43 can comprise hinged, two-link collapsible struts or braces, extending down from the bottom of stairway 18 and are connected to lateral wall members 24 and 25. Support struts 42 and 43 pivotally support stairway 18 in a raised, game playing position in relation to carrying case 22. Support struts 42 and 43 are disposed at an angle x (FIG. 2) to provide sufficient support to stairway 18 when the stairway is in an upright, raised, playing position. Generally, angle x may range from about 20° to about 90°. In operation, angle x is such that stairway 18 is preferably positioned such that the tread and riser portions of the stairway are respectively disposed essentially parallel and perpendicular to carrying case 22 and the local terrain (which may or may not be perfectly horizontal) when the stairway is in its raised, game playing position.

For the sake of both compactness of the apparatus and protection of stairway 18 in storage and transport, it is preferred that in its collapsed, stored position (as shown in dashed lines in FIG. 2), stairway 18 has a depth "D", including stringer(s) and tread(s) (discussed below), whereby the stairway is disposed substantially at or below the height of carrying case 22 as established by the lateral wall members 24 and 25 and opposed end wall members 26 and 27. Game 10 may also include wheels, rollers, or casters, or similar means 44 at the rear of carrying case 22 for facilitating pushed or pulled transport of the apparatus over a ground surface, ranging from hard pavement to soft sand. Supports 45 are provided at the front of carrying case 22 to ensure stability and immobility of game 10 when it is being played.

Stairway 18 itself includes a plurality of steps 17, 19, 21, and 23. Each step comprises a riser portion 46 and a tread portion 48. The riser and tread portions of stairway 18 are supported by lateral stringers 52. Significantly, and unlike currently known stepball/stoopball rebound games, the present invention includes protruding edges or "nosings" 50 provided on tread portion(s) 48 of each step on the player-facing side of stairway 18. Nosings 50 overhang the riser portion(s) 46 therebeneath. Nosings 50 produce complicated, unpredictable bounces, caroms or rebounds, thereby enhancing the experience and challenge of a stepball game. That is, tread nosings 50 produce an element of rebound unpredictability which is unattainable by portable stepball/stoopball apparatus theretofore known in the art. An example of a rebound influenced by the presence of nosings 50 is depicted in FIG. 1.

As seen in that figure, ball 16 is thrown by player 12 (the pitcher) whereupon it first strikes tread portion 48 of lowermost step 17 of stairway 18. The ball then bounces from the lowermost tread portion 48 and strikes a junction of the upper region of the corresponding riser portion 46 and nosing 50 of tread portion 48 of the next higher step 19. The existence of nosing 50 in this instance changes the trajectory of the ball which is ultimately rebounded back to player 14 (the fielder). Were nosing 50 not present, the rebound to fielder 14 under similar toss conditions would quickly become predictable to the fielder, thereby deleteriously affecting the challenge of the game. It will be understood that the trajectory of the ball 16 shown in FIG. 1 from the pitcher 12 to the fielder 14 is only one of an essentially limitless number of trajectories that the ball may traverse in space because of the presence of stairway 18 having steps 17, 19, 21, and 23, including their respective tread portions of substantial depth and forwardly projecting nosings 50.

Figure 4:
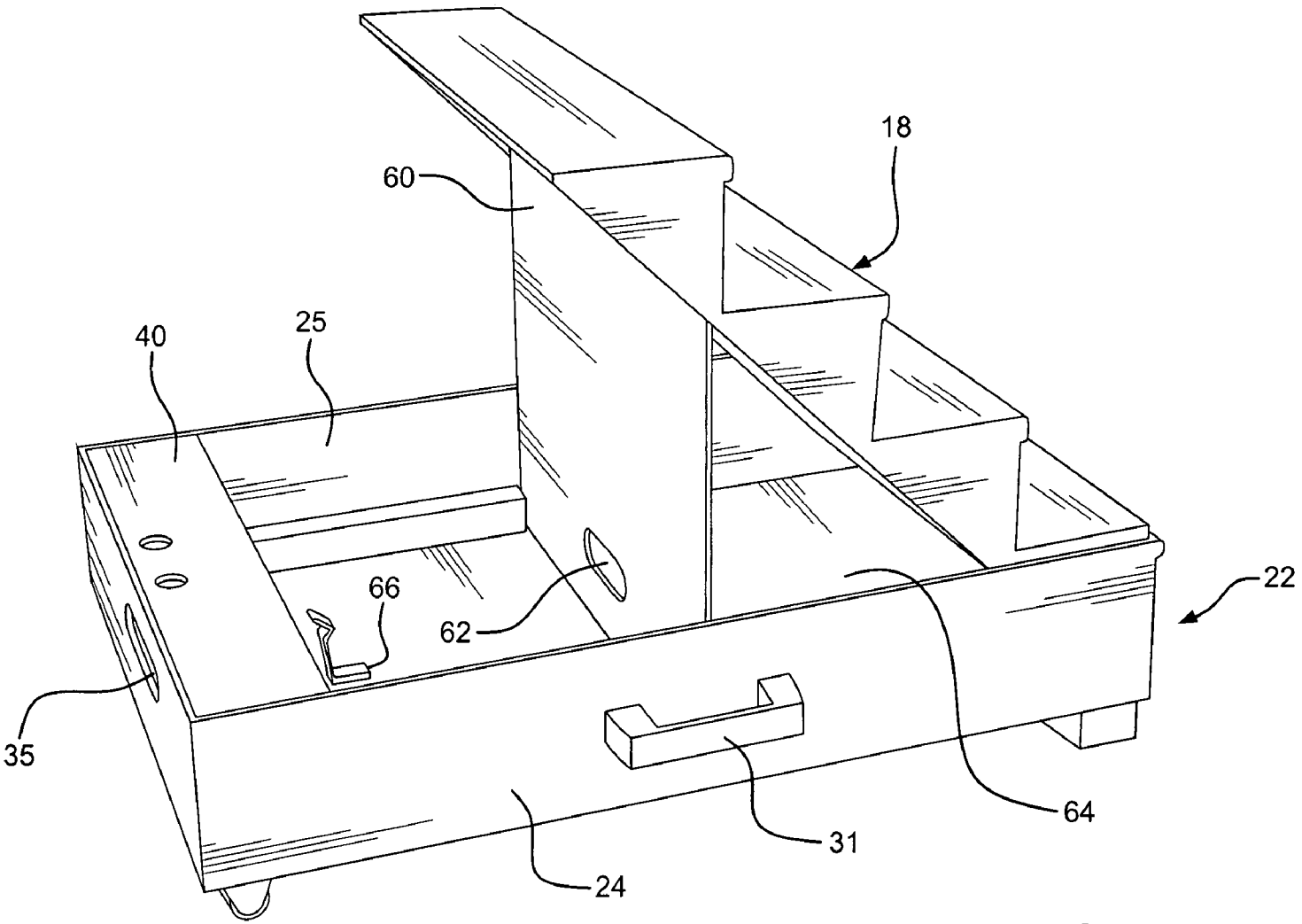
FIG. 4 is a rear perspective view of another embodiment of the stepball rebound ball game of the present invention in its raised, game playing position.
Figure 5:
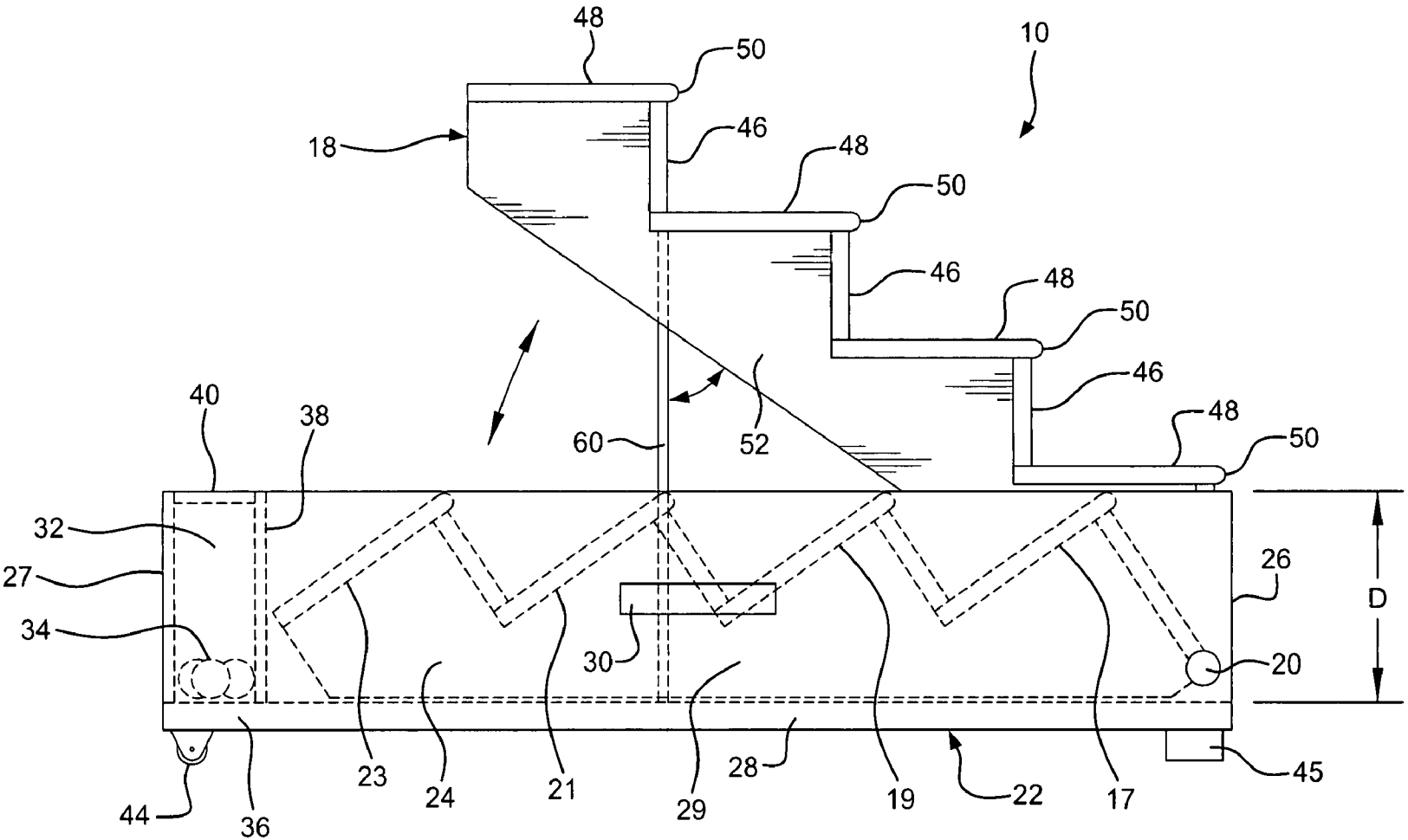
FIG. 5 is an elevation, ghosted view of the embodiment of the stepball rebound ball game of the present invention shown in FIG. 4, depicting its stairway in both its raised, game playing position and its stored position.

FIGS. 4 and 5 show a second embodiment of the game of the present invention. In this embodiment, stairway 18, located within carrying case 22, is supported in its raised, game playing position by panel 60. In this position, panel 60 extends vertically down, between the bottom of stairway 18 and case floor bottom 62, located between lateral wall members 24 and 25. To lower stairway 18 to its stored position within open space 29 of carrying case 22, panel 60 is simply removed by lifting stairway 18 up slightly and pulling slot 62 of the panel. Panel 60 is then placed horizontally on floor bottom 64, and secured thereon by clasp 66. Next, stairway 18 is rotated down into space 29 of carrying case 22 via pivot connection 20, where it rests on panel 60 for storage within the carrying case.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A portable, transportable rebound ball game comprising:

a portable, handheld carrying case having lateral and end wall members enclosing an open space;

a stairway comprising a plurality of steps;

connection means for attaching the lowermost step of the stairway to the lateral wall members of the carrying case, the connection means extending only through the lowermost step and the lateral wall members, whereby the stairway is moveable between a stored position wherein all the steps of stairway are located within the open space of the carrying case and a raised, game playing position wherein only the lowermost step of the stairway is within the open space of the carrying case;

stairway support means extending down from the bottom of the stairway for maintaining the stairway in the raised, game playing position, the support means and the connection means providing the sole support for retaining the stairway in its raised, game playing position; and handle means for permitting a player to manually lift the carrying case, with the stairway in its stored position therein, completely off the ground for transporting the portable game between different locations.

2. The rebound ball game as in claim 1 further comprising compartment means located within the carrying case for storing rebound ball game equipment, said compartment means having a cover operable between open and closed positions.

3. The rebound ball game as in claim 2 wherein the connection means is located at one end of the carrying case and the compartment means is located at the other end of the carrying case.

4. The rebound ball game as in claim 1 wherein the connection means is pivotably attached to the lowermost step of the stairway.

5. The rebound ball game as in claim 1 wherein the stairway support means consists of dual hinged struts pivotably connected between the bottom of the stairway and the lateral wall members.

6. The rebound ball game as in claim 1 wherein the stairway support means comprises a support panel extending vertically downward from the bottom of the stairway when the stairway is in the raised, game playing position.

7. The rebound ball game as in claim 6 wherein the carrying case further comprises a solid bottom member.

8. The rebound ball game as in claim 7 wherein the support panel is moveable from a substantially vertical position to maintain the stairway in its raised, game playing position, to a substantially horizontal position overlaying the bottom member when the stairway is in its stored position within the carrying case.

9. The rebound ball game as in claim 8 further comprising clasp means for maintaining the support panel in its horizontal position.

10. The rebound ball game as in claim 1 wherein each of the plurality of steps comprises edge means protruding over the steps for affecting the movement and trajectory of a ball thrown against and impacting the edge means.

11. The rebound ball game as in claim 1 wherein each step comprises a tread portion and a riser portion, said tread and riser portions being respectively disposed parallel and perpendicular to the carrying case when the stairway is in the raised, game playing position.

12. The rebound ball game as in claim 11 wherein the tread portions of each step each further comprise protruding edge means which overhang each riser portion for affecting the movement and trajectory of a ball thrown against and impacting the edge means.

13. The rebound ball game as in claim 1 wherein said carrying case further comprises a handle.

14. The rebound ball game as in claim 1 wherein said carrying case comprises means for facilitating pushed or pulled transport of the game.

* * * * *